US009528221B2

(12) United States Patent
Okada et al.

(10) Patent No.: US 9,528,221 B2
(45) Date of Patent: Dec. 27, 2016

(54) TREATMENT AGENT, METHOD FOR FORMING IMAGE, METHOD FOR PRODUCING TREATMENT AGENT, METHOD FOR PRODUCING FABRIC HAVING IMAGE, AND FABRIC HAVING IMAGE

(71) Applicant: BROTHER KOGYO KABUSHIKI KAISHA, Nagoya-shi, Aichi (JP)

(72) Inventors: Goro Okada, Nagoya (JP); Reiko Nishikawa, Kariya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/523,495

(22) Filed: Oct. 24, 2014

(65) Prior Publication Data

US 2015/0044372 A1 Feb. 12, 2015

Related U.S. Application Data

(62) Division of application No. 13/430,111, filed on Mar. 26, 2012, now abandoned.

(30) Foreign Application Priority Data

Mar. 30, 2011 (JP) ..... 2011-074123

(51) Int. Cl.

| | |
|---|---|
| ***D06P 1/52*** | (2006.01) |
| ***D06P 5/30*** | (2006.01) |
| ***D06P 1/673*** | (2006.01) |
| ***B05D 3/12*** | (2006.01) |
| ***B05D 1/26*** | (2006.01) |
| ***B05D 3/02*** | (2006.01) |

(Continued)

(52) U.S. Cl.

CPC ..... *D06P 1/525* (2013.01); *B05D 1/26* (2013.01); *B05D 3/0272* (2013.01); *B05D 3/12* (2013.01); *D06P 1/44* (2013.01); *D06P 1/673* (2013.01); *D06P 1/6735* (2013.01); *D06P 1/67333* (2013.01); *D06P 1/67341* (2013.01); *D06P 5/002* (2013.01); *D06P 5/2072* (2013.01); *D06P 5/30* (2013.01); *Y10T 428/24802* (2015.01)

(58) Field of Classification Search

None

See application file for complete search history.

(56) References Cited

U.S. PATENT DOCUMENTS

2011/0102497 A1 5/2011 Sato et al.

FOREIGN PATENT DOCUMENTS

| | | |
|---|---|---|
| EP | 2078786 A2 | 7/2009 |
| EP | 2233634 A1 | 9/2010 |

(Continued)

OTHER PUBLICATIONS

Office Action issued in European Patent Application No. 12 161 751.8 which corresponds to U.S. Appl. No. 13/430,111; Mar. 21, 2014.

*Primary Examiner* — Vu A Nguyen

(74) *Attorney, Agent, or Firm* — Fox Rothschild LLP

(57) ABSTRACT

Provided is a treatment agent used for forming an image on fabric, containing a resin emulsion and a metal salt. A pH of the treatment agent is in a range from 5.5 to 9. The pH may be adjusted using a pH adjuster. Examples of the pH adjuster include sodium bicarbonate, potassium carbonate, calcium carbonate, sodium hydroxide, sodium carbonate, triethanolamine, and N-butyl diethanolamine.

14 Claims, 4 Drawing Sheets

(51) Int. Cl.

| | |
|---|---|
| ***D06P 1/44*** | (2006.01) |
| ***D06P 5/00*** | (2006.01) |
| ***D06P 5/20*** | (2006.01) |

(56) References Cited

FOREIGN PATENT DOCUMENTS

| | | | |
|---|---|---|---|
| EP | 2362014 | A2 | 8/2011 |
| JP | 2001098473 | A | 4/2001 |
| JP | 2009-209493 | A | 9/2009 |
| WO | 2009/084600 | A1 | 7/2009 |

A

B

TREATMENT AGENT, METHOD FOR FORMING IMAGE, METHOD FOR PRODUCING TREATMENT AGENT, METHOD FOR PRODUCING FABRIC HAVING IMAGE, AND FABRIC HAVING IMAGE

CROSS-REFERENCE TO RELATED APPLICATION

This application is a divisional of U.S. patent application Ser. No. 13/430,111 filed on Mar. 26, 2012, which claims priority from Japanese Patent Application No. 2011-074123 filed on Mar. 30, 2011. The foregoing applications are incorporated herein by reference in their entireties.

BACKGROUND

An image forming method for forming an image by ejecting an ink on clothes such as a T-shirt and a bathing suit by an ink-jet method has been known. However, the image forming method causes bleeding of the ink on the surface of the cloth of the clothes, impregnating of the ink into the cloth, which result in a problem in image formation. As a method for solving this problem, a pretreatment method in which a pretreatment agent is adhered to a cloth prior to image formation on the cloth in order to suppress the bleeding of an ink on the surface of the cloth and the impregnating of an ink into the cloth has been proposed.

SUMMARY

A treatment agent is a treatment agent used for forming an image on fabric, comprising: a resin emulsion; and a metal salt, wherein a pH of the treatment agent is in a range from 5.5 to 9.

An image forming method is an image forming method for forming an image on fabric, comprising: a treatment step of applying a treatment agent on fabric; an image printing step of printing an image on a treatment agent-applied area with an ink; and a heat-fixing step of heat-fixing the ink on the fabric, wherein, as the treatment agent used in the treatment step, the above-described treatment agent is used.

A first method for producing a treatment agent is a method for producing a treatment agent, used for forming an image on fabric, comprising: a first step of mixing a resin emulsion and a metal salt; and a second step of adding a pH adjuster to a mixture obtained in the first step under a state where the metal salt is being ionized so as to adjust a pH of the mixture in a range from 5.5 to 9.

A second method for producing a treatment agent is a method for producing a treatment agent, used for forming an image on fabric, comprising: a first step of mixing a resin emulsion and a pH adjuster; and a second step of adding a metal salt to a mixture obtained in the first step so as to adjust a pH of the mixture in a range from 5.5 to 9.

A method for producing fabric having an image comprises the step of: forming an image on fabric by the above-described image forming method.

Fabric having an image is produced by the above-described method for producing fabric having an image.

DETAILED DESCRIPTION

Figure 1:
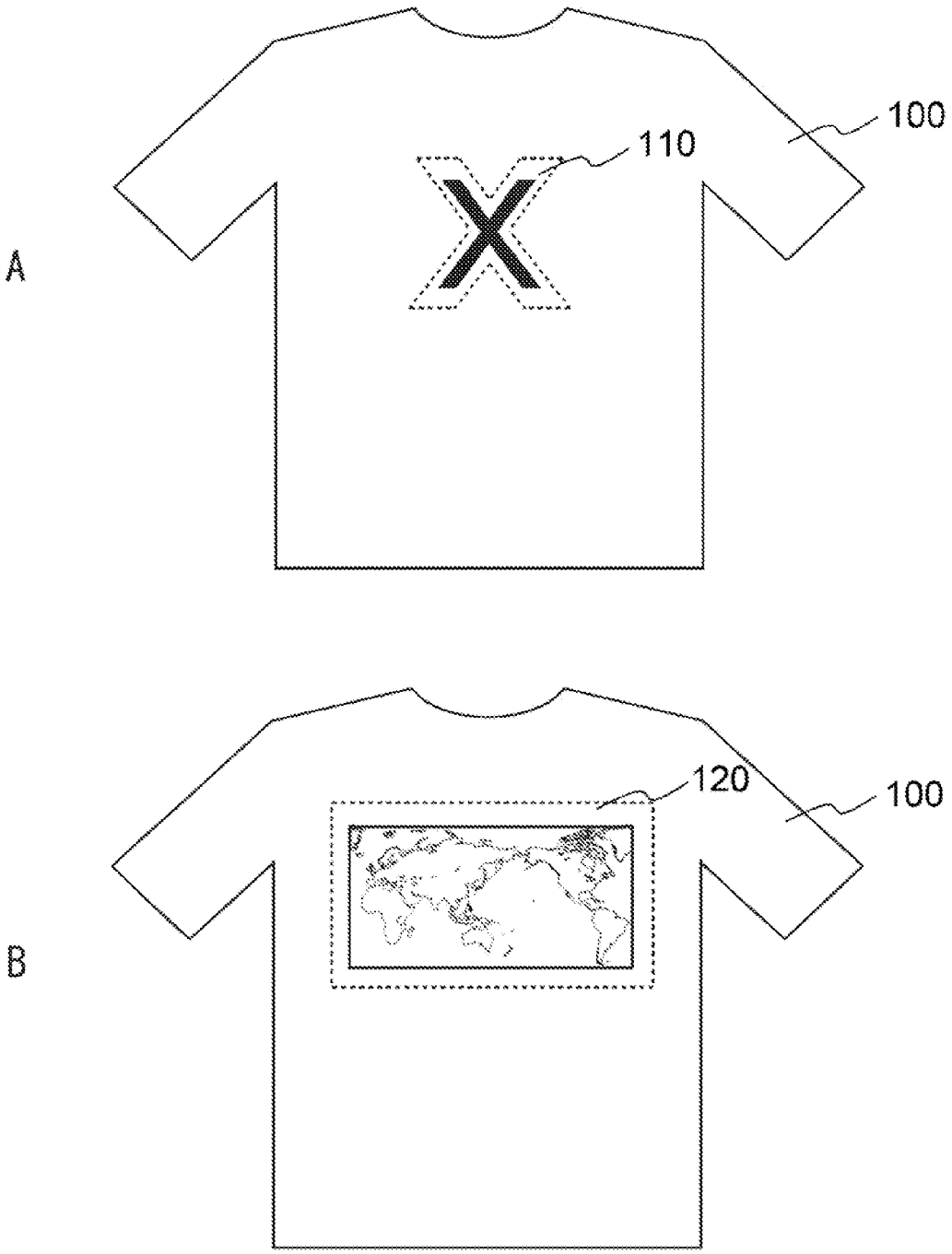
FIG. 1A is a view showing an example of image formation by the image forming method.
FIG. 1B is a view showing another example of image formation by the image forming method.

A treatment agent is used for forming an image on fabric. Examples of the fabric include clothes such as T-shirts, bathing suits, and sweat shirts, bags, shoes, slippers, socks, furniture such as sofas, and fabric goods such as flags. The fabric includes both woven fabric and knitted fabric. A material of the fabric may be a natural fiber or a cotton blended fiber characterized by being formed by mixing synthetic resin cotton and natural cotton. Examples of the synthetic fiber include a polyester fiber, a nylon fiber, and an acrylic fiber, and it may be the polyester fiber. Examples of the natural fiber include cotton and silk. The material of the fabric may be blended fabric obtained by spinning a mixture of the various kinds of fibers. For example, in the present invention, it is possible that an image is formed on sheet fabric or thin film fabric, which is then sewn to clothes and fabric products.

As mentioned above, the treatment agent comprises a resin emulsion and a metal salt.

The resin emulsion, for example, has a function of forming a treatment layer (treatment film) on the surface of fabric by a heat treatment or heat-fixing. The resin emulsion is not particularly limited, and examples thereof include an acrylic resin emulsion and a styrene resin emulsion. Among them, the resin emulsion may be the acrylic resin emulsion. As the resin emulsion, a commercially available product may be used, for example. The resin emulsions may be used alone or in the combination of two or more of them. The content of the resin emulsion in the treatment agent is not particularly limited, and the content relative to the total amount of the treatment agent is, for example, in the range from 1 wt % to 50 wt %, from 5 wt % to 45 wt %, or from 10 wt % to 40 wt %.

The metal salt, for example, has a function of flocculating a coloring agent in an ink when the ink used together with the treatment agent is in contact with the treatment layer (treatment film). The metal salt is not particularly limited, and examples thereof include aluminum chloride, aluminum bromide, aluminum sulfate, aluminum nitrate, aluminum acetate, barium chloride, barium bromide, barium iodide, barium oxide, barium nitrate, barium thiocyanate, calcium chloride, calcium bromide, calcium iodide, calcium nitrite, calcium nitrate, calcium dihydrogenphosphate, calcium thiocyanate, calcium lactate, calcium fumarate, calcium citrate, copper chloride, copper bromide, copper sulfate, cupric nitrate, copper acetate, iron chloride, iron bromide, iron iodide, iron sulfate, iron nitrate, iron oxalate, iron lactate, iron fumarate, iron citrate, magnesium chloride, magnesium bromide, magnesium iodide, magnesium sulfate, manganese sulfate, manganese nitrate, manganese dihydrogen phosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, and zinc acetate. Among them, the metal salt may be the calcium nitrate. The metal salts may be used alone or in the combination of two or more of them. The content of the metal salt in the treatment agent is not particularly limited, and the content relative to the total amount of the treatment agent is, for example, in the range from 1 wt % to 30 wt %, from 1 wt % to 20 wt %, or from 1 wt % to 15 wt %.

As mentioned above, a pH of the treatment agent is in the range from 5.5 to 9. The treatment agent comprises the resin emulsion and the metal salt, and the pH thereof is adjusted in the above-described range. Therefore, the treatment agent capable of forming an image on fabric without discoloration can be obtained. The pH of the treatment agent may be in the range from 5.5 to 6.5.

A method for adjusting a pH of the treatment agent is not particularly limited, and a pH adjuster may be used. Examples of the pH adjuster include alkali metal hydroxides, alkali metal carbonates, hydroxides of elements in Groups 2 to 12, carbonates of elements in Groups 2 to 12, and amines. Examples of the pH adjuster include sodium bicarbonate, potassium carbonate, calcium carbonate, sodium hydroxide, sodium carbonate, triethanolamine, N-butyl diethanolamine, sodium citrate (disodium citrate, trisodium citrate), potassium phosphate (potassium dihydrogen phosphate, dipotassium hydrogen phosphate, tripotassium phosphate), trisodium phosphate, sodium hydrogenphosphate (disodium hydrogenphosphate, sodium dihydrogen phosphate), and sodium dihydrogen pyrophosphate. Among them, the pH adjuster may be the sodium bicarbonate, the potassium carbonate, the calcium carbonate, the sodium hydroxide, the sodium carbonate, the triethanolamine, or the N-butyl diethanolamine. The pH adjusters may be used alone or in the combination of two or more of them. The content of the pH adjuster in the treatment agent is only necessary to be the content with which the pH of the treatment agent may be adjusted in the range from 5.5 to 9. The content relative to the total amount of the treatment agent is, for example, in the range from 0.01 wt % to 15 wt %, from 0.01 wt % to 10 wt %, or 0.01 wt % to 5 wt %.

The treatment agent may further comprise water. The water may be ion-exchange water or pure water. The amount of the water to be added relative to the total amount of the treatment agent may be, for example, the balance of the treatment agent, excluding the other components.

The treatment agent may further comprises a water-soluble organic solvent. As the water-soluble organic solvent, a conventionally known water-soluble organic solvent may be used. Examples of the water-soluble organic solvent include polyhydric alcohol, a derivative of the polyhydric alcohol, alcohol, amide, ketone, ketoalcohol, ether, a nitrogen-containing solvent, a sulfur-containing solvent, propylene carbonate, ethylene carbonate, and 1,3-dimethyl-2-imidazolidinone. Examples of the polyhydric alcohol include glycerin, ethylene glycol, diethylene glycol, propylene glycol, butylene glycol, hexylene glycol, triethylene glycol, polyethylene glycol, dipropylene glycol, tripropylene glycol, polypropylene glycol, trimethylol propane, 1,5-pentanediol, and 1,2,6-hexanetriol. Examples of the derivative of the polyhydric alcohol include ethylene glycol methyl ether, ethylene glycol ethyl ether, ethylene glycol n-propyl ether, ethylene glycol n-butyl ether, diethylene glycol methyl ether, diethylene glycol ethyl ether, diethylene glycol n-propyl ether, diethylene glycol n-butyl ether, diethylene glycol n-hexyl ether, triethylene glycol methyl ether, triethylene glycol ethyl ether, triethylene glycol n-propyl ether, triethylene glycol n-butyl ether, propylene glycol methyl ether, propylene glycol ethyl ether, propylene glycol n-propyl ether, propylene glycol n-butyl ether, dipropylene glycol methyl ether, dipropylene glycol ethyl ether, dipropylene glycol n-propyl ether, dipropylene glycol n-butyl ether, tripropylene glycol methyl ether, tripropylene glycol ethyl ether, tripropylene glycol n-propyl ether, and tripropylene glycol n-butyl ether. Examples of the alcohol include methyl alcohol, ethyl alcohol, n-propyl alcohol, isopropyl alcohol, n-butyl alcohol, sec-butyl alcohol, isobutyl alcohol, tert-butyl alcohol, and benzyl alcohol. Examples of the amide include dimethyl formamide and dimethyl acetamide. The ketone may be, for example, acetone. The ketoalcohol may be, for example, diacetone alcohol. Examples of the ether include tetrahydrofuran and dioxane. Examples of the nitrogen-containing solvent include pyrrolidone, 2-pyrrolidone, N-methyl-2-pyrrolidone, cyclohexyl pyrrolidone, and triethanolamine. Examples of the sulfur-containing solvent include thiodiethanol, thiodiglycol, thiodiglycerol, sulfolane, and dimethyl sulfoxide. The amount of the water-soluble organic solvent to be added relative to the total amount of the treatment agent is not particularly limited. The water-soluble organic solvents may be used alone or in the combination of two or more of them.

The treatment agent may further comprise a conventionally known additive(s), if necessary. Examples of the additive include a surfactant, a viscosity modifier, a surface tension modifier, an antioxidant, and a mildewproofing agent. Examples of the viscosity modifier include polyvinyl alcohol, cellulose, and a water-soluble resin.

A method for producing a treatment agent is not particularly limited, and for example, a treatment agent may be produced by a method for producing a treatment agent described below.

The image forming method is described below. The image forming method is an image forming method for forming an image on fabric, comprising: a treatment step of applying a treatment agent on fabric; an image printing step of printing an image on a treatment agent-applied area with an ink; and a heat-fixing step of heat-fixing the ink on the fabric, wherein, as the treatment agent used in the treatment step, the above-described treatment agent is used.

In the image forming method, the order of the treatment step and the image printing step is not limited and either one of the steps may be performed prior to the other, or the steps may be performed simultaneously. The heat-fixing step is performed after the image printing step. The image forming method may further comprise, for example, a heat-treatment step and a compression step, being described below, besides the above-described threes steps.

In the treatment step, the treatment agent may be applied by an ink-jet method, a spraying method, a stamping method, a brushing method, or a rolling method.

In the treatment step, the treatment agent may be applied to the whole or a part of an image forming side of the fabric. In the case of applying the treatment agent to a part of the image forming side of the fabric, an area to be printed with an ink of the image forming side is a treatment gent-applied area. In the case of applying the treatment agent to a part of the image forming side of the fabric, the treatment agent-applied area may be larger than the area to be printed. For example, as shown in FIG. 1A, in the case of printing the letter "X" on fabric (a T-shirt in this embodiment) 100, the treatment agent may be applied to form a treatment agent-applied area 110 having a line width wider than that of the letter. Further, for example, as shown in FIG. 1B, in the case of printing an image on the fabric (T-shirt) 100), the treatment agent may be applied to form a treatment agent-applied area 120 that is larger than the image.

The image forming method may comprise, after the treatment step, at least one of a heat-treatment step of heat-treating the treatment agent-applied area to dry and a compression step of compressing the treatment agent-applied area. The heat-treating may be performed using, for example, a hot pressing machine, an oven, or a conveyor belt oven, which is commercially available. In the case of using the hot pressing machine, the heat-treating may be performed in the state where a Teflon® sheet with a smooth surface is placed on the treatment agent-applied area. Thus, fuzz of the fabric may be suppressed, and the image printing step may be performed more smoothly when the image printing step is performed after the heat-treatment step and/or the compression step, for example. The temperature in the heat-treating is, for example, in the range from 160° C. to 185° C., although it is not particularly limited. In the image forming method, the treatment agent whose pH has been adjusted in the range from 5.5 to 9 is used. Therefore, even if the heat-treating is performed, discoloration on the fabric does not occur. The compression may be performed under the same conditions as those of the heat-treating using a commercially available hot pressing machine.

The image printing step is a step of printing an image on a treatment agent-applied area with an ink.

The ink used in the image printing step is not particularly limited, and a commercially available ink may be used, for example. The ink may be a water-based ink comprising a pigment, water, a water-soluble resin emulsion, and a water-soluble organic solvent, although an ink comprising a dye is also applicable.

Examples of the pigment include, but not limited to, carbon black, an inorganic pigment, and an organic pigment. Examples of the carbon black include furnace black, lamp black, acetylene black, and channel black. Examples of the inorganic pigment include titanium oxide, an iron oxide inorganic pigment, and a carbon black inorganic pigment. Examples of the organic pigment include azo pigments such as azo lake, an insoluble azo pigment, a condensed azo pigment, and a chelate azo pigment; polycyclic pigments such as a phthalocyanine pigment, a perylene and perynone pigment, an anthraquinone pigment, a quinacridone pigment, a dioxazine pigment, a thioindigo pigment, an isoindolinone pigment, and a quinophthalone pigment; dye lake pigments such as a basic dye lake pigment and an acid dye lake pigment; a nitro pigment; a nitroso pigment; and an aniline black daylight fluorescent. Further, other pigments may be used as long as they are dispersible to an aqueous phase. Examples of the pigments include C. I. Pigment Black 1, 6, and 7; C. I. Pigment Yellow 1, 2, 3, 12, 13, 14, 15, 16, 17, 55, 73, 74, 75, 83, 93, 94, 95, 97, 98, 114, 128, 129, 138, 150, 151, 154, 180, 185, and 194; C. I. Pigment Orange 31 and 43; C. I. Pigment Red 2, 3, 5, 6, 7, 12, 15, 16, 48, 48:1, 53:1, 57, 57:1, 112, 122, 123, 139, 144, 146, 149, 166, 168, 175, 176, 177, 178, 184, 185, 190, 202, 221, 222, 224, and 238; C. I. Pigment Violet 196; C. I. Pigment Blue 1, 2, 3, 15, 15:1, 15:2, 15:3, 15:4, 16, 22, and 60; and C. I. Pigment Green 7 and 36.

The amount of solid content of the pigment to be added (solid content of the pigment) relative to the total amount of the water-based ink is not particularly limited and may be decided suitably depending on, for example, a desired optical density or color. The solid content of the pigment in the water-based ink is, for example, in the range from 0.1 wt % to 20 wt % or from 3.0 wt % to 10 wt %.

The water may be ion-exchange water or pure water. The amount of the water to be added relative to the total amount of the water-based ink (the proportion of the water in the water-based ink) is decided suitably depending on, for example, desired ink properties. The amount of the water to be added may be, for example, the balance of the ink, excluding other components.

The water-soluble resin emulsion, for example, has a function of dispersing the pigment in the ink and serves as a binder for fixing the pigment on fabric.

Various emulsions each having a glass-transition temperature of about 0° C. or lower may be employed as the water-soluble resin emulsion. Examples of the water-soluble resin emulsions include an acrylic emulsion, an urethane emulsion, a polyester emulsion, a polystyrene emulsion, and combinations thereof. Among them, the water-soluble resin emulsion may be the acrylic emulsion.

The water-soluble resin emulsion may be any of anionic emulsions, cationic emulsions, and nonionic emulsions. The water-soluble resin emulsion may have any properties and may be, for example, any of micro-emulsions, gloss emulsions, reactive emulsions, room temperature crosslinkable emulsions, and double-layered emulsions. The average volume particle size of the resin fine particles composing the water-soluble resin emulsion is, for example, in the range from 10 nm to 200 nm or from 50 nm to 150 nm.

The amount of solid content of the water-soluble resin emulsion to be added (solid content of the water-soluble resin emulsion) relative to the total amount of the water-based ink may be in the range from 4 wt % to 15 wt %. By adjusting the amount of solid content of the water-soluble resin emulsion to 4 wt % or more, dispersibility of the pigment in the ink and fixability of the pigment to the fabric may be improved. Further, by adjusting the amount of the solid content of the water-soluble resin emulsion to 15 wt % or less, a water-based ink with superior ejection stability may be obtained, for example, in the case where the image printing step is performed by an ink-jet method.

In the case where the image printing step is performed by an ink-jet method, the water-soluble organic solvent serves as a humectant that prevents an ink from drying at a nozzle tip portion of an ink-jet head, for example.

Examples of the humectant include, but not limited to, lower alcohols such as methyl alcohol, ethyl alcohol, n-propyl alcohol, isopropyl alcohol, n-butyl alcohol, sec-butyl alcohol, and tert-butyl alcohol; amides such as dimethylformamide and dimethylacetamide; ketone such as acetone; ketoalcohol such as diacetone alcohol; ethers such as tetrahydrofuran and dioxane; polyalcohols such as polyalkylene glycol, alkylene glycol, and glycerin; 2-pyrrolidone; N-methyl-2-pyrrolidone; and 1,3-dimethyl-2-imidazolidinone. Examples of the polyalkylene glycol include, but not limited to, polyethylene glycol and polypropylene glycol. Examples of the alkylene glycol include, but not limited to, ethylene glycol, propylene glycol, butylene glycol, diethylene glycol, triethylene glycol, dipropylene glycol, tripropylene glycol, thiodiglycol, and hexylene glycol. Among them, the humectant may be polyethylene glycol or diethylene glycol. These humectants may be used alone or in the combination of two or more of them.

The water-based ink may further comprise a conventionally known additive(s), if necessary. Examples of the additive include a surfactant, a viscosity modifier, a surface tension modifier, and a mildewproofing agent. Examples of the viscosity modifier include, but not limited to, polyvinyl alcohol, cellulose, and a water-soluble resin.

The water-based ink may be prepared, for example, by uniformly mixing the pigment, water, the water-soluble resin emulsion, the water-soluble organic solvent, and optionally other addition components by a conventionally known method, and then removing sediments with a filter or the like.

In the case of printing an image on polyester with the ink comprising a dye, the polyester may be dyed under high temperature conditions (for example, in the range from 120° C. to 130° C.) using an ink comprising a dispersive dye. Although the dispersive dye is not soluble or hardly soluble in water, the dispersive dye is used in the condition where it is micronized and dispersed in water using a dispersant (a surfactant).

Figure 2:
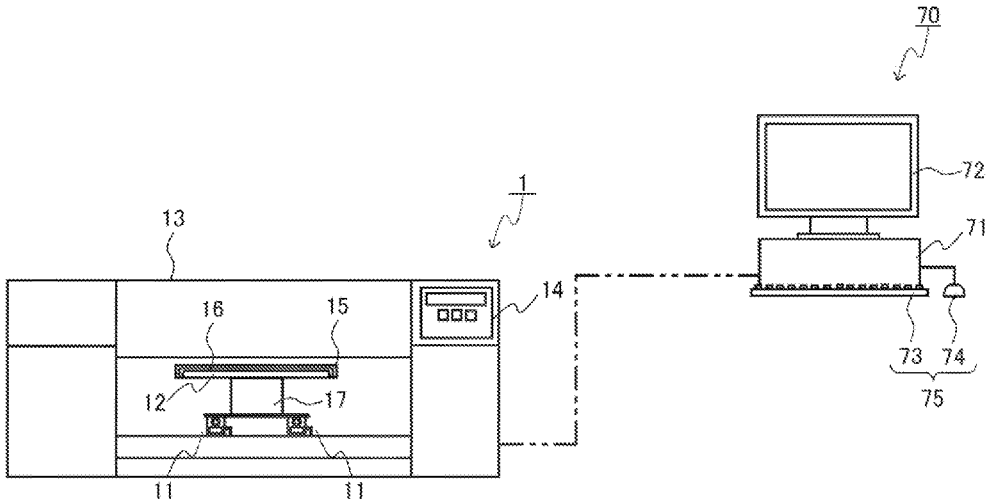
FIG. 2 is a schematic diagram showing an example of the configuration of an ink-jet recording apparatus.

The image printing step may be performed using, for example, the ink-jet recording apparatus shown in FIG. 2. In the ink-jet recording apparatus of this embodiment, the image printing step is performed by an ink-jet recording. As shown in FIG. 2, this ink-jet recording apparatus comprises: an ink-jet printer 1 for printing a desired image by ejecting an ink on fabric; and a printing control device 70 for obtaining an image data on the desired image and controlling the ink-jet printer, which are connected through an interface.

Figure 3:
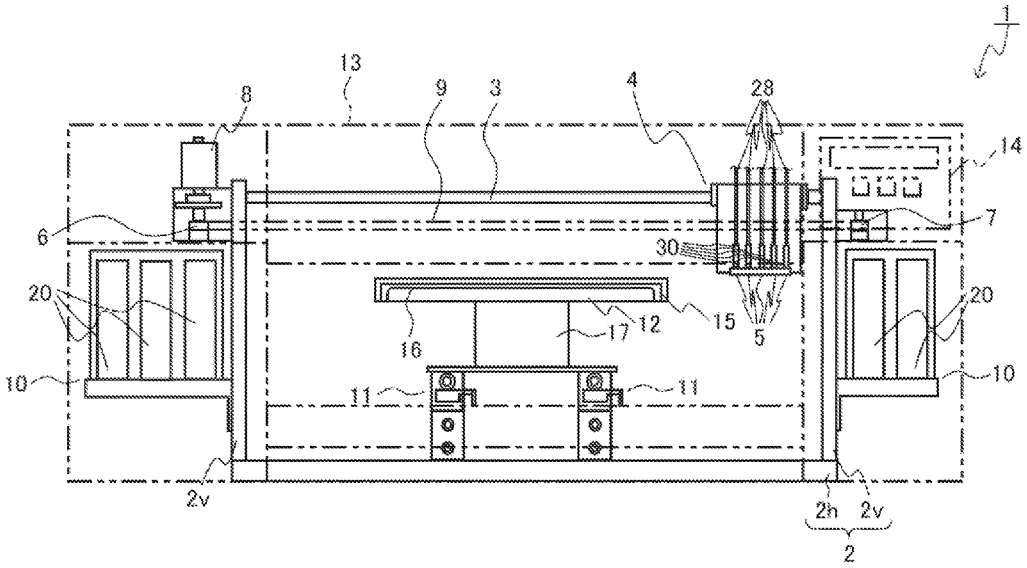
FIG. 3 is a front view showing an example of the configuration of an ink-jet printer of the ink-jet recording apparatus.
Figure 4:
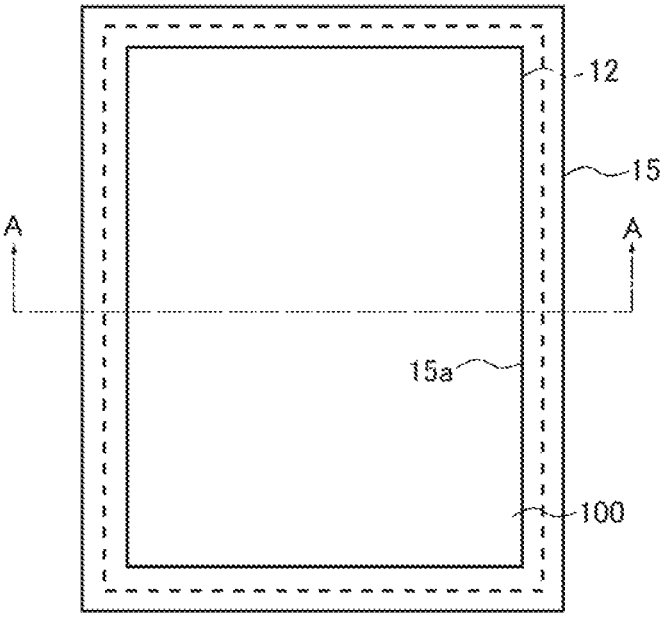
FIG. 4A is a plan view showing the state where fabric is set on a platen of the ink-jet recording apparatus.
FIG. 4B is a cross sectional view taken along the line A-A of FIG. 4A.
Figure 4:
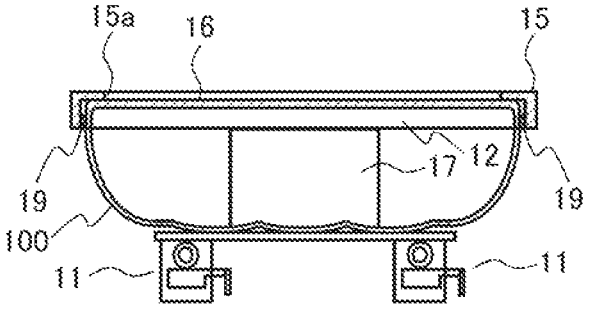

As shown in FIG. 3, the ink-jet printer 1 is provided with a frame 2. The frame 2 includes a horizontal portion 2*h* disposed on the bottom of the printer 1 and two vertical portions 2*v* extending perpendicularly to and upward from the respective ends of the horizontal portion 2*h*. In FIG. 3, identical parts to those in FIG. 2 are indicated by identical reference numerals, and the same applies to FIGS. 4 to 6.

A slide rail 3 is horizontally disposed in such a manner that the upper portions of the respective vertical portions 2*v* are mutually linked. A carriage 4 is mounted on the slide rail 3 slidably in a longitudinal direction (main scanning direction) of the slide rail 3. Five piezoelectric ink-jet heads (ink ejection units) 5 are disposed for the respective five colors in order to eject inks of the five colors and are provided on the lower surface of this carriage 4.

Pulleys 6 and 7 are supported on the upper portions of the respective vertical portions 2*v*, and a motor shaft of a motor 8 supported by the vertical portion 2*v* is linked to one side of the pulley 6. An endless belt 9 is extended between the pulleys 6 and 7, and the carriage 4 is fixed to an appropriate portion of the endless belt 9.

With such a configuration, the carriage 4 reciprocates linearly along the longitudinal direction (main scanning direction) of the slide rail 3 as the motor 8 rotates the pulley 6 in the normal or reverse direction, and consequently the ink-jet heads 5 reciprocate.

The two vertical portions 2*v* are provided with the respective mounting portions 10, on which ink tanks 20 are detachably mounted. Among the mounting portions 10, one is arranged to hold two ink tanks 20 each containing a different color ink and the other is arranged to hold three ink tanks 20 each containing a different color ink. Each ink tank 20 includes an ink bag (not shown) therein. The ink bags of the ink tanks 20 are respectively connected, through flexible tubes 28, to five sub tanks 30 disposed on the upper portions of the respective inkjet heads 5. The sub tanks 30 are in communication with the respective inkjet heads 5 as described below. Thus inks are supplied from the ink tanks 20 to the respective ink-jet heads 5.

A slide mechanism 11 is provided on the horizontal portion 2*h* of the frame 2. The slide mechanism 11 supports a platen (support) 12. This platen 12 is provided with a fixing frame (fixing unit) 15 so that fabric is set on the platen 12 with the side on which an image to be printed up and is set in a flat state without creases. The ink-jet printer 1 of this embodiment performs ink-jet printing on a T-shirt that has been sewed. However, the ink-jet printer 1 may be applied to fabric in general. Further, in the ink-jet printer 1 of this embodiment, the number of the platens 12 is one. However, the number of the platens is not limited to one and may be more if necessary. For example, when the ink-jet printer is provided with two platens, fixation of a T-shirt to one of the platens may be performed while an image is printed on another T-shirt fixed on the other of the platens. Therefore, working efficiency may be increased.

Further, a platen moving mechanism (not shown) is provided in order to reciprocate the platen 12 in a direction perpendicular to the paper surface in FIG. 3 (the sliding direction of the slide mechanism 11, which forms an auxiliary scanning direction of the ink-jet printer 1). A rack, a pinion mechanism, a mechanism using an endless belt, or the like may be employed for the platen moving mechanism.

FIGS. 4A and 4B show the state where fabric is set on a platen. FIG. 4A is a plan view, and FIG. 4B is a cross sectional view taken along the line A-A of FIG. 4A. As shown in FIGS. 4A and 4B, the platen 12 is a rectangle having the longitudinal direction in a direction orthogonal to the reciprocating direction of the carriage 4 from the planar view. The platen 12 includes a support surface 16 that supports a T-shirt 100. Further, a part of the lower surface of the platen 12 at the farthest side in a direction perpendicular to the paper surface in FIG. 4B is linked to the slide mechanism 11 at the corresponding position through a support member 17. Further, each of the longitudinal sides of the platen 12 has an arc shaped upper end.

The fixing frame 15 has an L-shaped cross section, and the frame covers the four sides of the support surface 16 of the platen 12. The fixing frame 15 includes, at the side facing the support surface 16 of the platen 12, an opening portion 15*a* having an opening area slightly smaller than the area of the support surface 16 of the platen 12. Further, the fixing frame 15 includes, at the inner surface facing the side surface of the platen 12, an antiskid member 19 made of rubber. In the case where the T-shirt 100 is set on the platen 12, the antiskid member 19 allows the T-shirt 100 to be set in a state of being stretched in two directions, i.e., the longitudinal direction of the support surface 16 (the longitudinal direction of the T-shirt 100) and the lateral direction of the support surface 16 (the lateral direction of the T-shirt 100), and thus the T-shirt 100 is held without creases. At the time of setting the T-shirt 100 on the platen 12, the T-shirt 100 is set from the hem side in such a manner that the T-shirt covers the support surface 16 of the platen 12 and is fixed with the fixing frame 15. Further, the fixing frame 15 is provided rotatably by means of a rotation portion (not shown) provided at the end portion of the platen 12 positioned at the farthest side in a direction perpendicular to the paper surface in FIG. 4B. The T-shirt 100 is fixed between the platen 12 and the fixing frame 15 by rotating the fixing frame 15 so as to fit to the platen 12 after covering the platen 12 with the T-shirt 100.

The ink-jet printer 1 is provided with a cover 13. The cover 13 covers the ink-jet heads 5, the slide mechanism 11, and the like to protect them. Note here that the cover 13 is illustrated by chain double-dashed lines, so that the configuration inside the cover 13 is shown in detail in FIG. 3. The cover 13 is provided with, at the upper right-hand portion of the front side thereof, an operation panel 14, which includes a liquid crystal panel and operation buttons.

The five ink-jet heads 5 shown in FIG. 3 of respective five inks (white, yellow, magenta, cyan, and black) are provided along the reciprocating direction of the carriage 4. The ink-jet heads 5 are communicated with respective ink tanks 20 through the flexible tubes 28 and the sub tanks 30. As the configuration for supplying an ink to an ink-jet head, a conventionally known configuration may be employed (see JP 2004-291461 A, for example), for example.

By linking the ink tanks 20 to the sub tanks 30 through the flexible tubes 28, it becomes possible to supply inks in the ink tanks 20 to the respective sub tanks 30 and to provide the ink tanks 20 at places where they are easily exchangeable. Therefore, when inks in the ink tanks 20 run out, the ink tanks 20 may easily be changed.

Each of the ink-jet heads 5 is provided in such a manner that a gap is formed between the lower surface thereof and the support surface 16 of the platen 12. An area to be printed of the T-shirt 100 that is set on the platen 12 is fed into the gap at the time of printing an image on the T-shirt 100. According to this configuration, by reciprocating the ink-jet heads 5 by the carriage 4 while ejecting each of the color inks from plural ejection nozzles with micro-diameters formed on the bottom surfaces of the ink-jet heads 5 on the T-shirt 100, a desired color image is printed on the T-shirt 100.

The printing control device 70 shown in FIG. 2 is composed of a general-purpose personal computer (PC), for example. The printing control device 70 is provided with a body 71, a display as a display portion 72, and as an operation portion 75, a keyboard 73 and a mouse (pointing device) 74.

Figure 5:
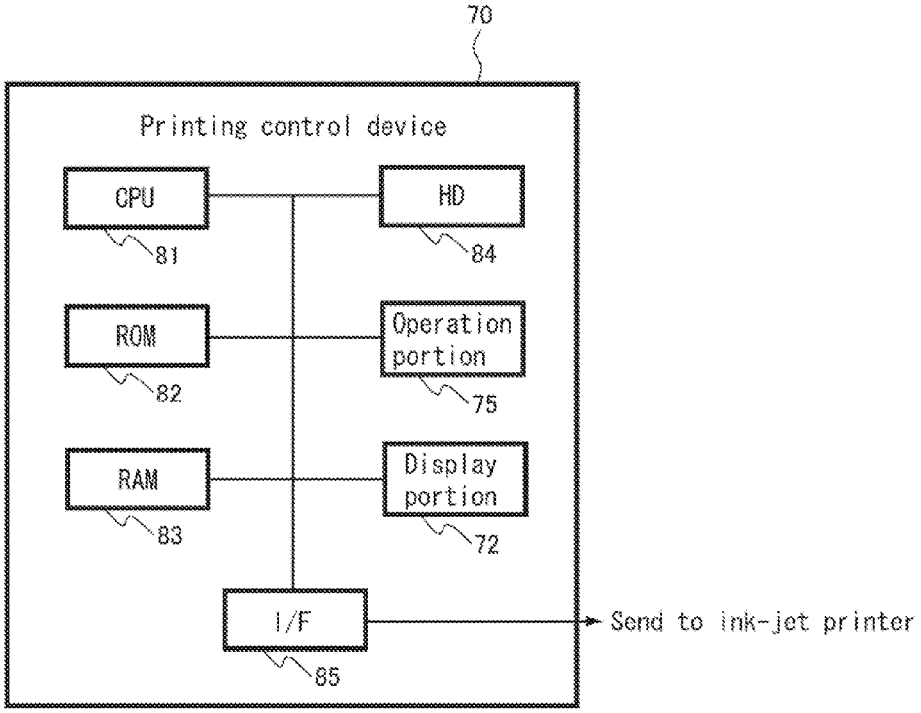
FIG. 5 is a block diagram showing the configuration of the ink-jet recording apparatus.

FIG. 5 is a block diagram showing the configuration of the printing control device 70 shown in FIG. 2. The printing control device 70 is provided with a central processing unit (CPU) 81, a read only memory (ROM) 82, a random access memory (RAM) 83, a hard disk (HD) 84, an operation portion 75, a display portion 72, and an interface (I/F) 85, and they are mutually connected through buses. The CPU 81, the ROM 82, the RAM 83, and the HD 84 are installed inside of the body 71 of the printing control device 70, and the operation portion 75 is composed of the keyboard 73 and the mouse 74.

Various programs used for controlling operations of the printing control device 70 are stored in the HD 84. Further, various data on image and various data on every fabric such as a T-shirt, being created by software are stored in the HD 84. The CPU 81 performs various computations and processing on the basis of signals input by the operation portion 75 and the various programs and data stored in the ROM 82, the RAM 83, and the HD 84. Then, the CPU 81 sends data to the ink-jet printer 1 through the interface 85. The RAM 83 is a readable and writable volatile memory that stores results of the various computations performed by the CPU 81. The interface 85 is connected to the interface of the ink-jet printer 1 and allows communication between the printing control device 70 and the ink-jet printer 1.

Figure 6:
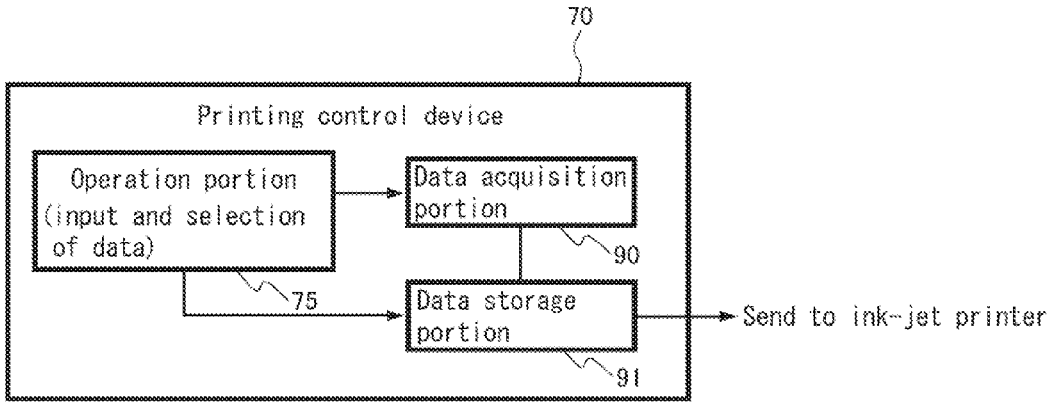
FIG. 6 is a block diagram showing the function of the ink-jet recording apparatus.

FIG. 6 is a block diagram showing the function of the printing control device 70. As shown in FIG. 6, the printing control device 70 is provided with an image data acquisition portion 90 and an image data storage portion 91. In this embodiment, the image data acquisition portion 90 is implemented by the CPU 81 and the image data storage portion 91 is composed of the RAM 83 or the HD 84.

The image data acquisition portion 90 has a known function of creating image data and creates various image data on the basis of signals input by an operator through the keyboard 73 and the mouse 74. The image data storage portion 91 stores image data collected from removable storage media such as CD-ROM, FD, and MO, the internet, and the like. Further, the data storage portion 91 stores image data acquired by the image data acquisition portion 90.

Printing of a desired image on the T-shirt 100 using the ink-jet recording apparatus of this embodiment is performed, for example, as follows. First, image data desired to be printed on the T-shirt 100 is acquired through the keyboard 73 and the mouse 74 of the PC. Acquisition of the image data may be performed by creating image data using software installed in the PC or selecting image data preliminarily stored in the HD 84.

Next, the T-shirt 100 is fixed on the platen 12. Specifically, the T-shirt 100 is set on the platen 12 from the hem side in such a manner that the platen 12 is covered with the T-shirt 100 along the support surface 16 thereof, and the T-shirt 100 is fixed with the fixing frame 15 without creases.

Then, when an operator provides an instruction to perform printing, the image data is sent to the ink-jet printer 1 through the interface 85 and inks are ejected from the ink-jet heads 5 on the basis of the image data. Accordingly, printing is performed on the T-shirt 100 fixed on the platen 12.

The ink-jet recording apparatus may further comprise a treatment agent storage portion and a treatment agent ejection unit. The treatment agent storage portion stores the treatment agent therein. According to the present invention, an ink-jet recording apparatus including: a support having a support surface of supporting fabric; a fixing unit for fixing the fabric on the support surface; an ink storage portion; and an ink ejection unit, wherein the ink-jet recording apparatus further comprises: a treatment agent storage portion and a treatment agent ejection unit, the treatment agent stored in the treatment agent storage portion is ejected on the fabric that is on the support surface, and an ink stored in the ink storage portion is ejected on an area to which the treatment agent is ejected by the ink ejection unit, is provided. The configuration for supplying the treatment agent to the treatment agent ejection unit may be the same as that for supplying inks to the ink-jet heads.

The ink-jet recording apparatus may further include a heating unit. The heating unit is applicable as long as it performs the heat-fixing step in the ink-jet recording apparatus, being described below. The heating unit may be, for example, hot pressing or the like, that applies heat and pressure to the area to be printed of fabric. Alternatively, the ink-jet recording apparatus may further include a pressurizing unit besides the heating unit. The order of the heating and the pressurizing is not particularly limited and either one of them may be performed prior to the other or both of them may be performed simultaneously.

The image printing step may comprise a base area forming step of forming a base area on the treatment agent-applied area with a first ink and an image printing step of printing an image on the base area with a second ink. A white ink may be used as the first ink, and a color ink may be used as the second ink. For example, a white ink containing a white pigment such as titanium oxide may be used as the white ink. With this configuration, a color image with superior color developing properties may be formed even on fabric of deep color. For example, when the ink-jet recording apparatus is exclusively used for forming an image on fabric of light color, the ink-jet recording apparatus is not necessary to include an ink-jet tank and an ink-jet head, for a white ink.

The image printing step is performed by ink-jet recording in this embodiment. The image printing step may be performed by screen printing, gravure printing, stenciling, or the like using a conventionally known device or mechanism.

The heat-fixing step is a step of heat-fixing the ink on the fabric by heat-treating the area to be printed of the fabric. The heat-fixing step may be performed using the same devices as those used in the heat-treatment step under the same conditions as those of the heat-treatment step. Further, the heat-fixing step may be performed using the device disclosed in JP 2009-209493 A. When the device disclosed in JP 2009-209493 A is used, heat at 180° C. and pressure are applied to the fabric. In the image forming method, the treatment agent whose pH has been adjusted in the range from 5.5 to 9 is used. Therefore in the heat-fixing step, discoloration on the fabric does not occur.

The method for producing a treatment agent is described below. The treatment agent may be produced by, for example, a production method comprising: a first step of mixing the resin emulsion and the metal salt; and a second step of adding a pH adjuster to a mixture obtained in the first step under a state where the metal salt is being ionized so as to adjust a pH of the mixture in a range from 5.5 to 9. The treatment agent may be produced also by, for example, a production method comprising: a first step of mixing a resin emulsion and a pH adjuster; and a second step of adding a metal salt to a mixture obtained in the first step so as to adjust a pH of the mixture in a range from 5.5 to 9. Note here that these production methods are illustrative, and the treatment agent may be the one produced by any method. In the method for producing a treatment agent, conditions such as the types and the contents of the resin emulsion, the metal salt, and the pH adjuster are the same as those for the above-described treatment agent.

The method for producing fabric having an image and fabric having an image are described below. The method for producing fabric having an image comprises the step of: forming an image on fabric by the above-described image forming method. The fabric having an image is produced by the method for producing fabric having an image. In the production of fabric having an image, the treatment agent whose pH has been adjusted in the range from 5.5 to 9 is used. Therefore, fabric without discoloration may be obtained.

EXAMPLES

Next, the examples of the present invention are described together with the comparative examples. The present invention, however, is not limited or restricted by the following examples and the comparative examples.

(Preparation of Treatment Agent)

Treatment agents 1 to 14 were obtained by uniformly mixing their components shown in composition of the treatment agents (Table 1).

TABLE 1

| | | Treatment agent | | | | | | | |
|---|---|---|---|---|---|---|---|---|---|
| | | 1 | 2 | 3 | 4 | 5 | 6 | 7 | 8 |
| Acrylic resin emulsion | | 30.0 | 30.0 | 30.0 | 30.0 | 30.0 | 30.0 | 30.0 | 30.0 |
| Metal salt | Calcium nitrate | 4.0 | 4.0 | 4.0 | 4.0 | 4.0 | 4.0 | 4.0 | 4.0 |
| pH adjuster | Sodium hydrogen carbonate (*1) | 1.0 | 1.1 | 2.0 | — | — | — | — | — |
| | Sodium carbonate (*2) | — | — | — | 0.6 | 0.7 | — | — | — |
| | Sodium hydrate | — | — | — | — | — | 0.6 | 0.8 | 0.9 |
| | Triethanolamine (*3) | — | — | — | — | — | — | — | — |
| | N-BDA (*4) | — | — | — | — | — | — | — | — |
| | Calcium chloride | — | — | — | — | — | — | — | — |
| Surfactant | | 1.0 | 1.0 | 1.0 | 1.0 | 1.0 | 1.0 | 1.0 | 1.0 |
| Pure water | | Balance | Balance | Balance | Balance | Balance | Balance | Balance | Balance |

| | | Treatment agent | | | | | |
|---|---|---|---|---|---|---|---|
| | | 9 | 10 | 11 | 12 | 13 | 14 |
| Acrylic resin emulsion | | 30.0 | 30.0 | 30.0 | 30.0 | 30.0 | 30.0 |
| Metal salt | Calcium nitrate | 4.0 | 4.0 | 4.0 | 4.0 | 4.0 | 4.0 |
| pH adjuster | Sodium hydrogen carbonate (*1) | — | — | — | — | — | — |
| | Sodium carbonate (*2) | 50 | — | — | — | — | — |
| | Sodium hydrate | — | — | — | — | 0.1 | 1.2 |
| | Triethanolamine (*3) | — | 0.5 | — | — | — | — |
| | N-BDA (*4) | — | — | 1.0 | — | — | — |
| | Calcium chloride | — | — | — | — | — | — |
| Surfactant | | 1.0 | 1.0 | 1.0 | 1.0 | 1.0 | 1.0 |
| Pure water | | Balance | Balance | Balance | Balance | Balance | Balance |

(*1): 0.5 mol/kg
(*2): 0.05 wt % solution
(*3): 2 mol/l solution
(*4): N-butyl diethanolamine (2 mol/l solution)
Unit of amount to be added in treatment liquid composition: wt %

(Preparation of Water-Based Color Ink)

20 wt % of each of four pigments which are described below was stirred for 30 minutes or longer so as to be dispersed in a mixture containing 10 wt % of diethylene glycol and 70 wt % of ion-exchange water using a disperser (Sand Grinder, produced by Igarashi Kikai), and thereby obtained a pigment dispersion liquid. A water-soluble resin emulsion (acrylic resin, Joncryl 1674 (product name, a solid content of 45%), produced by Johnson Polymer Corporation), polyethylene glycol (PEG, molecular weight of 400), and diethylene glycol (DEG, molecular weight of 106) were added to the pigment dispersion liquid so that the resultant mixture has the water-based ink composition which is described below. The mixture was stirred for 5 minutes and then pressure-filtrated with a 3-μm membrane filter or a 5-μm metal filter. Thus, each of a water-based yellow ink, a water-based magenta ink, a water-based cyan ink, and a water-based black ink was obtained.

(Pigment)

Water-based yellow ink: C. I. Pigment Yellow 74
Water-based magenta ink: C. I. Pigment Red 122
Water-based cyan ink: C. I. Pigment Blue 15:3
Water-based black ink: C. I. Pigment Black 7

Water-Based Color Ink Composition

| | |
|---|---|
| Pigment | 4 wt % |
| Water-soluble resin emulsion | 8 wt % (solid content concentration) |
| Polyethylene glycol (PEG) | 5 wt % |
| Diethylene glycol (DEG) | 15 wt % |
| Ion-exchange water | Balance |

(Note that the pigment concentration of a water-based black ink was 8 wt %.)

(Preparation of Water-Based White Ink)

[Preparation of Polymer Dispersant Solution]

<Preparation of Polymer Dispersant Solution 1>

25 parts by mass of a copolymer of solid acrylic acid/n-butyl acrylate/benzyl methacrylate/styrene, having a glass-transition temperature of 40° C., a mass-average molecular weight of 10,000, and an acid value of 150 mg KOH/g, was dissolved in a mixture of 3.2 parts by mass of sodium hydroxide and 71.8 parts by mass of water, and thereby obtained a polymer dispersant solution 1 having a resin solid content of 25 mass %.

[Preparation of White Ink Base]

<Preparation of White Ink Base 1>

19 parts by mass of water was added to 36 parts by mass of the polymer dispersant solution 1, which was then mixed. Thus, resin varnish for titanium dioxide dispersion was prepared. Then, 45 parts by mass of titanium dioxide (CR-90, alumina-silica treatment (alumina/silica≥0.5), average primary particle size of 0.25 μm, oil absorption of 21 mL/100 g, produced by ISHIHARA SANGYO KAISHA, LTD.) was added to the resin varnish, which was then mixed by stirring. Thereafter, the resultant mixture was milled with a wet circulation mill and thereby obtained a white ink base 1 (titanium dioxide/dispersant=1/0.2 (mass ratio)).

[Preparation of Water-Based White Ink]

<Preparation of Water-Based White Ink>

40 parts by mass of an anionic acrylic resin emulsion having a glass-transition temperature of −38° C. (Mowinyl 952 (product name), produced by Nichigo-Mowinyl Co., LTD., solid content of 45 mass %), 15 parts by mass of glycerin, 1 part by mass of Acetylenol E100 (ethylene oxide adduct of acethylene glycol, produced by Kawaken Fine Chemicals Co., Ltd.), and 10.7 parts by mass of water were added to 33.3 parts by mass of the white ink base 1, which was then mixed by stirring. Thus, a water-based white ink was obtained.

Example 1

The respective color images were formed on four types of T-shirts (Ultra Cotton (product name) (light blue and pink), manufactured by GILDAN and BEEFY (product name) (heather blue and salmon pink), manufactured by Hanes) by the following steps using the treatment agent 1, the water-soluble white ink, and the water-soluble color ink.

(Treatment Step)

The treatment agent 1 was diluted to two times the weight thereof using pure water. The diluted treatment agent 1 of from 10.0 g to 30.0 g was uniformly applied to a image forming surface of each of the T-shirts, with a size from 370 mm×420 mm to 420 mm×470 mm by a spraying method. The respective amounts of applying the treatment agent 1 per unit area in the examples and the comparative examples are shown in Table 2.

(Heat-Treatment Step)

After the treatment step, the treatment agent-applied area of the T-shirt was heat-treated by hot-pressuring the T-shirt with a hot pressing machine set at 180° C. Thus, the treatment agent 1-applied area was dried and compressed.

(Image Printing Step)

After the heat-treatment step, the water-based whit ink was ejected to the T-shirt using the ink-jet recording apparatus shown in FIG. 2. Thus, a base area was formed on the treatment agent 1-applied area. Subsequently, the water-based color inks were ejected to the T-shirt using the ink-jet recording apparatus shown in FIG. 2. Thus, a color image was printed on the base area.

(Heat-Fixing Step)

After the image printing step, the printed area of the T-shirt was heat-treated by hot-pressing the T-shirt with a hot pressing machine set at 180° C. Thus, the water-based white ink and the water-based color inks were heat-fixed on the T-shirt, and the printed area was pressurized.

Examples 2 to 11

Color images were formed on the respective T-shirts in the same manner as in Example 1 except that the treatment agents 2 to 11 were used, respectively.

Comparative Example 1

Color images were formed on the respective T-shirts in the same manner as in Example 1 except that the treatment agent was not used.

Comparative Examples 2 to 4

Color images 12 to 14 were formed on the respective T-shirts in the same manner as in Example 1 except that the treatment agents 12 to 14 were used, respectively.

With respect to the examples and the comparative examples, (a) evaluation of discoloration, (b) evaluation of storing stability, (c) evaluation of washing fastness, and (d) comprehensive evaluation were made according to the following methods.

(a) Discoloration Evaluation

The color difference ΔE between a treatment agent-applied area and a non treatment agent-applied area of each of the T-shirts after the heat-treatment step was evaluated according to the following evaluation criteria. The measurement of the color difference ΔE was conducted using a spectrophotometric densitometer, X-Rite 939 (light source D65/10) manufactured by X-Rite.

Evaluation Criteria for Discoloration Evaluation

A: The color difference ΔE was less than 3.50.

B: The color difference ΔE was from 3.50 to less than 6.00.

C: The color difference ΔE was 6.00 or more.

(b) Storing Stability Evaluation

The respective treatment agents used in the examples and the comparative examples were stored for 2 weeks under the environment of 60° C., and thereafter storing stability evaluations of the treatment agents were made according to the following evaluation criteria.

Evaluation Criteria for Storing Stability Evaluation

G: The changes in viscosity, surface tension, and pH, of the treatment agent from before storage to after storage were all 10% or less.

NG: Any of the changes in viscosity, surface tension, and pH, of the treatment agent from before storage to after storage was in excess of 10%.

(c) Washing Fastness Evaluation

Each of the T-shirts each having a color image was washed for 5 times according to the AATCC test method 135-2004 IIIA, and then washing fastness was evaluated according to the following evaluation criteria.

Evaluation Criteria for Washing Fastness Evaluation

G: The washing fastness of each of four types of T-shirts was 3-grade or higher according to the rating of Japan Dyer's Inspection Institute Foundation.

NG: The washing fastness of any of four types of T-shirts was lower than 3-grade according to the rating of Japan Dyer's Inspection Institute Foundation.

(d) Comprehensive Evaluation

With respect to the examples and the comparative examples, comprehensive evaluations were made according to the following evaluation criteria based on the results of the evaluations (a) to (c).

Evaluation Criteria for Comprehensive Evaluation

G: The results of the evaluations (a) to (c) were not C or NG, but A, B, or G.

NG: Any of the results of the evaluations (a) to (c) was C or NG.

The types of the respective treatment agents used in the examples and the comparative examples, the amounts of applying the respective treatment agents, and the pHs of the respective treatment agents are shown in Table 2.

TABLE 2

| | Example | | | | | | | | | | | Comparative Example | | | |
|---|---|---|---|---|---|---|---|---|---|---|---|---|---|---|---|
| | 1 | 2 | 3 | 4 | 5 | 6 | 7 | 8 | 9 | 10 | 11 | 1 | 2 | 3 | 4 |
| Treatment agent | 1 | 2 | 3 | 4 | 5 | 6 | 7 | 8 | 9 | 10 | 11 | none | 12 | 13 | 14 |
| Applied amount ($g/cm^2$) | 0.014 | 0.015 | 0.013 | 0.013 | 0.015 | 0.013 | 0.015 | 0.015 | 0.014 | 0.014 | 0.015 | — | 0.013 | 0.013 | 0.015 |
| pH | 5.66 | 5.70 | 5.88 | 5.61 | 5.90 | 7.3 | 8.3 | 8.7 | 6.4 | 7.0 | 9.0 | — | 4.6 | 5.3 | 9.4 |
| Discoloration evaluation | A | A | A | B | B | B | B | B | A | B | A | — | C | C | C |
| Storing stability evaluation | G | G | G | G | G | G | G | G | G | G | G | — | G | G | G |
| Washing fastness evaluation | G | G | G | G | G | G | G | G | G | G | G | NG | G | G | G |
| Comprehensive evaluation | G | G | G | G | G | G | G | G | G | G | G | NG | NG | NG | NG |

As shown in Table 2, all of the results of the discoloration evaluation, the storing stability evaluation, and the washing fastness evaluation were favorable in Examples 1 to 11 using the treatment agents whose pHs were in the range from 5.5 to 9. In contrast, the result of the washing fastness evaluation was unfavorable in Comparative Example 1 using no treatment agent. Moreover, the results of the discoloration evaluation were unfavorable in Comparative Examples 2 to 4 using the treatment agents whose pHs were from less than 5.5 to in excess of 9.

It will be obvious to those having skill in the art that many changes may be made in the above-described details of the particular aspects described herein without departing from the spirit or scope of the invention as defined in the appended claims.

What is claimed is:

1. A method for preventing discoloration in fabric, comprising:

a treatment step of applying, on fabric, a treatment agent, the treatment agent comprising a resin emulsion and a metal salt and having a pH of 5.5 to 9;

a compression step of compressing the treatment agent-applied area;

a heat-treatment step of heat-treating the treatment agent-applied area in a range from 160° C. to 185° C. after the treatment step;

an image printing step of printing an image on a treatment agent-applied area with an ink after the heat-treatment step; and a heat-fixing step of heat-fixing the ink on the fabric after the image printing step, wherein discoloration on the treatment agent-applied area in the heat-treatment step is prevented by the use of the treatment agent in the treatment step.

2. The method according to claim 1, wherein the treatment agent further comprises a pH adjuster, and the pH adjuster is at least one selected from the group consisting of alkali metal hydroxides, alkali metal carbonates, hydroxides of elements in Groups 2 to 12, carbonates of elements in Groups 2 to 12, and amines.

3. The method according to claim 2, wherein the pH adjuster is at least one selected from the group consisting of sodium bicarbonate, potassium carbonate, calcium carbonate, sodium hydroxide, sodium carbonate, triethanolamine, and N-butyl diethanolamine.

4. The method according to claim 1, wherein the resin emulsion is an acrylic resin emulsion.

5. The method according to claim 1, wherein the metal salt is calcium nitrate.

6. The method according to claim 1, wherein as the ink used in the image printing step, an ink comprising a pigment is used.

7. The method according to claim 1, wherein the image printing step is performed by ink-jet recording.

8. The method according to claim 1, wherein
the image printing step comprises:
a base area forming step of forming a base area on the treatment agent-applied area with a first ink; and
an image printing step of printing an image on the base area with a second ink.

9. The method according to claim 8, wherein
a white ink is used as the first ink.

10. The method according to claim 8, wherein
a color ink is used as the second ink.

11. The method according to claim 1, wherein
the heat-treatment step and the compression step are performed at the same time using a hot pressing machine, and
the image printing step is performed after the heat-treatment step and the compression step.

12. The method according to claim 11, wherein
the heat-treatment step and the compression step are performed using the hot pressing machine in the state where a sheet is placed on the treatment agent-applied area.

13. The method according to claim 12, wherein
the heat-treatment step and the compression step are performed using the hot pressing machine in the state where a sheet with a smooth surface is placed on the treatment agent-applied area.

14. The method according to claim 12, wherein
the heat-treatment step and the compression step are performed using the hot pressing machine in the state where a Teflon® sheet is placed on the treatment agent-applied area.

* * * * *